United States Patent [19]

Shum et al.

[11] Patent Number: 4,727,937

[45] Date of Patent: Mar. 1, 1988

[54] STEAMFLOOD PROCESS EMPLOYING HORIZONTAL AND VERTICAL WELLS

[75] Inventors: Yick M. Shum, Armonk, N.Y.; Margaret A. Hight; Alfred Brown, both of Houston, Tex.

[73] Assignee: Texaco Inc., White Plains, N.Y.

[21] Appl. No.: 914,435

[22] Filed: Oct. 2, 1986

[51] Int. Cl.[4] ..... E21B 43/24

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 4,166,501 | 9/1979 | Kerstad et al. | 166/263 |
| 4,166,502 | 9/1979 | Hall et al. | 166/263 |
| 4,166,503 | 9/1979 | Hall et al. | 166/263 |
| 4,166,504 | 9/1979 | Brown et al. | 166/263 X |
| 4,177,752 | 11/1974 | Brown et al. | 166/263 |
| 4,283,088 | 8/1981 | Tabakor et al. | 299/2 |
| 4,321,966 | 3/1982 | Traverse et al. | 166/263 X |
| 4,324,291 | 4/1982 | Wong et al. | 166/263 X |
| 4,390,067 | 6/1983 | Willman | 166/245 |
| 4,488,600 | 12/1984 | Fan | 166/263 |
| 4,489,783 | 12/1984 | Shu | 166/263 X |
| 4,522,260 | 6/1985 | Wolcott | 166/245 |
| 4,637,461 | 1/1987 | Hight | 166/263 X |
| 4,645,003 | 2/1987 | Huang et al. | 166/263 X |

*Primary Examiner*—George A. Suchfield

*Attorney, Agent, or Firm*—Jack H. Park; Kenneth R. Priem; Harold J. Delhommer

[57] ABSTRACT

An oil recovery process employing a well pattern having a horizontal well located along each of the four sides of a substantially rectangular well pattern, a vertical injection well located at the center of the well pattern, and four vertical infill wells located midway between the central injection well and the four corners of the rectangular well pattern. Steam is initially injected through the central injection well and production taken at the four infill walls. After the injection of about 0.5 to about 1.0 pore volumes of steam through the central injection well, central injection is converted to water, the infill production wells are converted to steam injection, and production is taken from the horizontal wells.

5 Claims, 5 Drawing Figures

STEAMFLOOD PROCESS EMPLOYING HORIZONTAL AND VERTICAL WELLS

BACKGROUND OF THE INVENTION

The invention process is concerned with the enhanced recovery of oil from underground formations. More particularly, the invention relates to a sequenced process for recovering hydrocarbons with steam and water employing patterns containing horizontal and vertical wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9-spot having an unsually large number of injection wells. U.S. Pat. No. 4,390,067 illustrates a scheme of using horizontal and vertical wells together to form a pentagonal shaped pattern which is labeled a "5-spot" in the patent, although the art recognizes a different pattern as constituting a 5-spot.

U.S. Pat. Nos. 4,166,501; 4,166,503 and 4,177,752 describe various schemes employing infill wells which are located between central injectors and corner wells of square well patterns. The disclosures are strictly limited to infill well patterns employing vertical wells, and not horizontal wells.

SUMMARY OF THE INVENTION

The invention is an oil recovery method utilizing a combination of substantially vertical and substantially horizontal wells, wherein a horizontal well is located along each of the four sides of a substantially rectangular well pattern, a substantially vertical injection well is located at the center of the well pattern, and four substantially vertical infill wells are located approximately midway between the central injection well and the four corners of the rectangular well pattern. Steam is initially injected into the formation through the central injection well, and hydrocarbons and other fluids are produced at the four infill wells. After the injection of enough steam through the central injection well to fill about 0.5 to about 1.0 pore volumes of the formation located within a pattern formed by the four infill wells, the infill production wells are converted to injection wells. At this time, water is injected through the central injection well instead of steam, steam is injected into the formation through the infill wells, and hydrocarbons and other fluids are produced from the horizontal wells. After a suitable period of time, the steam injection through the infill wells may also be converted to water injection. Preferably, the water injected is hot water.

DETAILED DESCRIPTION

Figure 1:
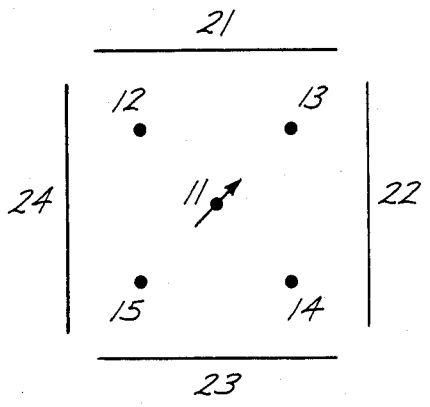
FIGS. 1–4 illustrate several well patterns used in the invention process.
Figure 2:
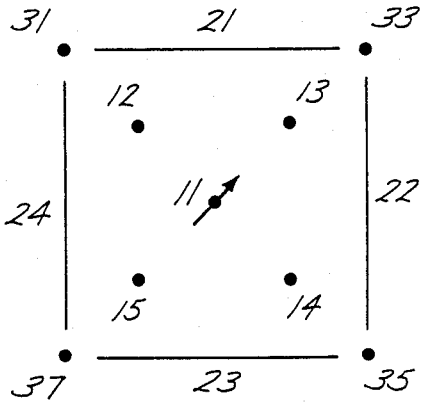

Although steam floods by central well injection in inverted 5-spot and inverted 9-spot well patterns have attained oil recoveries in excess of 50%, these well patterns can leave areas of high oil saturation in the lower layers of oil sands. High residual oil saturations are left in thick oil sands. The additional production of infill wells between central injectors and corner wells are effective in improving steam conformance, but still fail to reduce oil saturation in the lower layers in the areas between the corner and side wells. Horizontal wells drilled between corner wells of rectangular well patterns can improve vertical conformance of the steamflood and increase oil recovery to a large degree. The inclusion of these horizontal wells may also allow the use of larger pattern sizes. Such horizontal and vertical well combination patterns are also particularly applicable to thick reservoirs where steam override is a major drawback to steamflood operations.

In its simplest form, the invention requires the use of an inverted 5-spot, inverted 9-spot, or inverted 13-spot well pattern to which four substantially horizontal wells have been drilled between the four corner wells of the well patterns. Four substantially vertical infill wells must also exist or be drilled and completed approximately midway between the central injection well and the four corners of the substantially rectangular well patterns.

The well patterns may or may not have vertical corner wells. Such corner wells are not required to practice the invention, and in fact, it is preferred to shut-in such vertical corner wells prior to producing at the horizontal wells.

The combination vertical and horizontal well patterns employed in the present invention may also include substantially vertical side wells located between the corners of the substantially rectangular well patterns. As they may reduce overall hydrocarbon recovery, it is preferred that these vertical side wells be shut-in and not employed in the invention method.

If vertical wells already exist to form an inverted 13-spot well pattern or an inverted 9-spot well pattern with infill wells, then it is only necessary to drill and complete the four horizontal wells prior to practicing the invention method. Optionally, eight instead of four horizontal production wells may be employed, each lying between a side well and a corner well along the pattern boundary, or a pair of horizontal wells lying between each pair of corner wells.

If existing wells form an inverted 5-spot or an inverted 9-spot, then it is only necessary to drill and complete the four infill wells and the four horizontal wells between the corners of the rectangular well pattern. An inverted 5-spot can also be expanded to a larger pattern size wherein the four corner wells of the inverted 5-spot serve as the infill wells in the invention well method, making it only necessary to drill the four horizontal wells. Standard 5-spot and 9-spot patterns can be employed by changing the necessary wells from injection to production and production to injection.

The invention method entails injecting steam through the central injection wells until enough steam has been injected to fill about 0.5 to about 1.0 pore volumes of the formation located within a pattern formed by the four infill wells. At this time, the infill production wells are converted to injection wells. Water instead of steam is injected into the formation through the central injection well and steam is injected into the formation through the infill wells. Hydrocarbons and other fluids are produced from the horizontal production wells. It is preferred that the water injected into the formation be hot water.

Water is injected since it is much less costly than steam and there is a need to maintain a positive pressure gradient to prevent oil resaturation in the previously flooded, oil depleted zone of the reservoir. The water injection will also serve to scavenge some of the heat remaining in the depleted zone and carry that heat to the higher oil saturation areas. Produced water can be used as a source of injection water.

An additional embodiment comprises injecting a non-condensible gas into the formation through the central injection well after steam injection and prior to water injection to further maintain the steam front. The injection of a non-condensible gas also serves to maintain a positive pressure gradient and help prevent steam front collapse upon contact with the following injected water. Non-condensible gases which may be used include carbon dioxide, nitrogen, air, flue gas, methane, ethane and mixtures of the above.

FIGS. 1–4 illustrate several different well patterns which can be used to practice the invention process. Horizontal wells 21, 22, 23 and 24 are placed along the sides of a substantially rectangular well pattern having central injection well 11 at its approximate center. Substantially vertical infill wells 12, 13, 14 and 15 are shown inside the rectangular well pattern. Substantially vertical corner wells 31, 33, 35 and 37 and substantially vertical side wells 32, 34, 36 and 38 are also shown.

Figure 3:
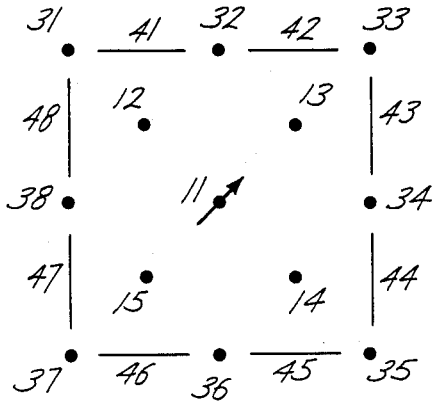
Figure 4:
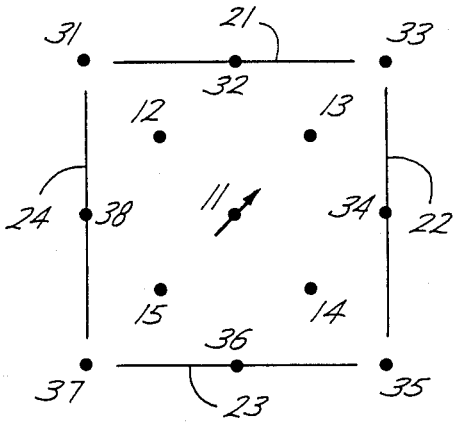

The pattern of FIG. 3 which was used in Examples also contains horizontal wells 41, 42, 43, 44, 45, 46, 47 and 48. These wells extend between each pair of side and corner wells. Although it is possible to practice the invention with the well pattern of FIG. 3, the well patterns of FIGS. 1, 2 and 4 offer less costly ways to practice the invention than the pattern of FIG. 3. It is cheaper to drill a single horizontal well between two corner wells than it is to drill two horizontal wells at the same location. However, a single horizontal well can be perforated so that it produces similarly to two horizontal wells drilled between two corner wells and separated by a side well. It should be remembered that higher oil recovery is achieved with the invention process when corner wells and side wells are shut-in.

The diameter and length of the horizontal wells and the perforation intervals are not critical, except that such factors will effect the well spacing and the economics of the process. Such decisions should be determined by conventional drilling criteria, the characteristics of the specific formation, the economics of a given situation, and well known art of drilling horizontal wells. The distance of horizontal wells from other vertical wells is a balance of economic criteria. Perforation size will be a function of other factors such as flow rate, temperatures and pressures employed in a given operation. Preferably, the horizontal wells will be extended into the formation at a position near the bottom of the formation.

Such horizontal wells must run a substantially horizontal distance within the hydrocarbon formation. To communicate with the surface, horizontal wells may extend from the surface or may extend from a substantially vertical well within the formation, which communicates with the surface. Newly developed horizontal well technology has now made it possible to drill substantially horizontal wells from an existing vertical wellbore. The horizontal wells may even run parallel to and within a pay zone having a certain degree of dip. Such wells are still considered horizontal wells for the purposes of this invention.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific Software-Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9-spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

Infill wells were added to the simulation grid midway between center and corner wells to form an inverted 13-spot pattern. The wells were completed in the lower one-third of the zone only and infill production began after three years of steam injection and continued to the end of the project.

Ultimate recovery was 63.2% of the original oil in place after 11 years. Note that the advantage of infill wells is to recover oil sooner. For the inverted 9-spot pattern of Ex. 1, the oil recovery at 11 years would have been only 57% at this time. Because of the presence of infill wells, oil production which would otherwise arrive at corner and side wells will be reduced. As a result, the inverted 13-spot pattern would reach an economic limit much sooner than an inverted 9-spot pattern unless other operational changes are made.

The oil saturation profile for Example 2 is about the same as for Ex. 1, but is reached four years sooner than in Ex. 1. There is still a high oil saturation region in the area between the corner and side wells.

EXAMPLES 3–5

Eight horizontal wells were added to the 13-spot pattern of Example 2 such that the horizontal wells were located along the sides of the rectangular well pattern between each pair of side and corner wells. The procedure of Example 2 was followed on the pattern of FIG. 3. Infill well production was begun after three years. After six years of injection through the central injector which corresponded to the injection of almost one pore volume of steam, the infill wells were converted to injection wells at a steam injection rate of 300 bbl/day (cold water equivalent) through each infill well. Steam injection through the central injection well was reduced to 1200 bbl/day. Horizontal well production was also started at this time, six years after initiation of injection through the central injection well.

Example 4 was the same as Example 3 except that hot water injection was initiated at the central injector at a rate of 2400 bbl/day at the same time that the infill production wells were converted to infill injection wells.

Example 5 was the same as Example 4 except that the hot water injection rate at the central injector was 4800 bbl/day instead of the 2400 bbl/day of Example 4.

Figure 5:
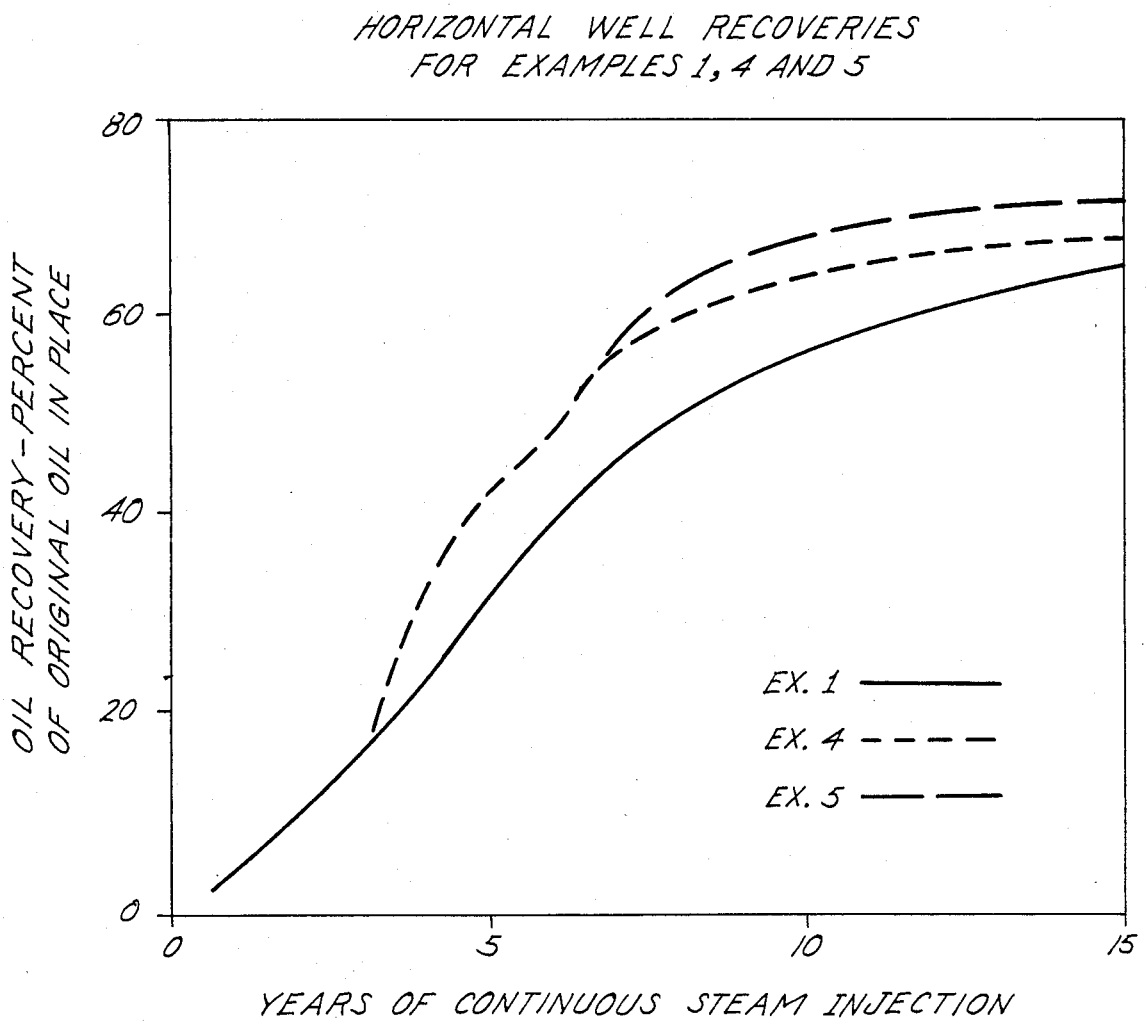
FIG. 5 graphs the oil recovery of several example runs of the invention process.

The results of the invention method Examples 4 and 5 are shown in FIG. 5 along with the base case of Example 1 for comparison. The best recovery of 67% of original oil in place after 10 years and 71.1% of original oil in place after 15 years was achieved with Example 5. Example 5 also gave the best steam oil ratio with a cumulative steam oil ratio at the end of 15 years of 3.2 compared with 5.0 for the base case of Example 1. Example 4 performed according to the invention method gave the next best recovery results. By contrast, Example 1 done on an inverted 9-spot pattern without infill wells or horizontal wells yielded 64.7% of the original in place after 15 years, but the steam bypassed most of the lower 40% of the oil zone. Example 2 performed with an inverted 13-spot pattern containing infill wells gave an ultimate recovery of 63.2% of the original oil in place after 11 years. However, there were still high oil saturation regions between the corner wells.

Example 3, which employed procedures similar to the invention procedure, gave a recovery of about 66% of the original oil in place. It is interesting to note that the conversion of steam injection to water injection at the central injection well actually increased oil recovery in Examples 4 and 5 over Example 3. This increase in oil recovery was also achieved with the cost savings of injecting cheaper hot water instead of expensive steam. Normally, one of ordinary skill in the art would expect a decrease in recovery from the injection of hot water after a steam front when compared to a case of continuously injected steam.

EXAMPLE 6

Example 5 was repeated with the corner and side wells of the pattern shut-in at the start of horizontal well production. Oil recovery increased from 71.1% to 73.6% of original oil in place. Shutting in the corner and side wells reduced the produced heat and gave a substantial advantage in recovery efficiency. This permitted all of the hydrocarbons and other fluids to be most efficiently produced from the horizontal production wells.

EXAMPLES 7–9

These three examples were run to test the effects of pattern size on the difference in performance between the invention procedure and another method. Examples 7 and 8 were run on an inverted 13-spot well pattern containing four infill wells. Example 2 was modified so that infill well production was begun after three years and was followed by a conversion to steam injection through the infill wells after six years. Steam injection rates for the infill wells were 300 bbl/day for each well and 1200 bbl/day for the central injection well. Example 7 was run on an 18.5 acre well pattern and Example 8 was simulated with a pattern size of 25 acres. Oil recoveries were 65.7% and 60.3% of original oil in place for Examples 7 and 8, respectively.

Example 9 was a repeat of Example 5 except that the pattern size was increased to 25 acres from 18.5 acres. Oil recovery decreased from 71.1% to 69.0% of original oil in place. Both of the larger patterns show higher oil recoveries at lower steam volumes with the horizontal well run of Example 5 showing the best response with less than one pore volume of steam injection. The fact that oil recovery decreased only 2% despite a 35% increase in pattern size to 25 acres for Example 9 indicates that the invention horizontal well processes are particularly suitable for larger well patterns. By spreading the well pattern over a larger area, the cost of drilling and completing horizontal wells per barrel of oil recovered can be substantially reduced.

EXAMPLES 10–11

Two more runs were performed to test the effect of oil zone thickness on the invention process. Examples 8 and 9 (25 acre patterns) were repeated with the thickness of the oil zone increased from 125 to 250 feet. With the invention procedure of Example 9, oil recovery dropped from 69% to 61.7% of original oil in place in Example 11 a the thickness of the oil zone doubled to 250 feet. Without the horizontal well invention process, steam override became a major problem as oil recovery dropped from the 60.3% of Example 8 to 38.0% of Example 10.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

TABLE 1

| RESERVOIR AND FLUID PROPERTIES - SIMULATION OF EXAMPLES 1–11 | |
|---|---|
| Porosity, fraction | 0.39 |

TABLE 1-continued

| RESERVOIR AND FLUID PROPERTIES - SIMULATION OF EXAMPLES 1-11 | | |
|---|---|---|
| Initial Fluid Saturations, Fraction: | | |
| Oil | | 0.589 |
| Water | | 0.411 |
| Gas | | 0 |
| Initial Reservoir Temperature, °F.(°C.) | | 100 (37.7) |
| Initial Reservoir Pressure, psi (kPa) | | 50 (345) |
| Permeability, md: | | |
| Horizontal ($\mu m^2$) | | 3000 (3) |
| Vertical ($\mu m^2$) | | 900 (0.9) |
| Reservoir Thermal Conductivity, Btu/day-ft-°F. (W/m-°C.) | | 31.2 (2.25) |
| Reservoir Heat Capacity, Btu/ft$^3$-°F. (kJ/m$^3$-°C.) | | 37.0 (2481) |
| Cap and Base Rock Thermal Conductivity, Btu/day-ft-°F. (W/m-°C.) | | 24.0 (1.73) |
| Cap and Base Rock Heat Capacity, Btu/ft$^3$-°F. (kJ/m$^3$-°C.) | | 46.0 (3085) |
| Oil Viscosity, | cp @ °F. | Pa.s @ °C. |
| | 1230 @ 100 | 1.23 @ 37.7 |
| | 10 @ 300 | 0.01 @ 148.9 |
| | 3.99 @ 400 | 0.00399 @ 204.4 |
| Quality of Injected Steam, fraction (at sand face) | | 0.65 |
| Residual Oil Saturation, Fraction | | |
| to water: | | 0.25 |
| to steam: | | 0.15 |

What is claimed is:

1. A method of recovering hydrocarbons from an underground formation by employing a modified five-spot pattern, which comprises:

drilling and completing four substantially horizontal wells, each horizontal well approximately located along each of the four sides of a substantially rectangular well pattern;

said substantially rectangular well pattern containing a substantially vertical central injection well and four substantially vertical infill wells located approximately midway between the central well and each of the four corners of the rectangular well pattern;

injecting steam into the formation through the central injection well;

producing hydrocarbons at the four infill wells;

after injecting enough steam through the central injection well to fill about 0.5 to about 1.0 pore volumes of the formation located within a pattern formed by the four infill wells, converting the infill production wells to injection wells;

injecting water instead of steam into the formation through the central injection well;

injecting steam into the formation through the infill wells; and producing hydrocarbons from the horizontal wells.

2. The method of claim 1, further comprising converting the steam injection at the infill wells to water injection as the steamflood matures.

3. The method of claim 2, wherein the water injected through the infill wells is hot water.

4. The method of claim 1, wherein the water injected through the central injection well is hot water.

5. The method of claim 1, further comprising injecting a non-condensable gas into the formation through the central injection well after steam injection through the central well and prior to water injection through the central well.

* * * * *